US006237307B1

(12) United States Patent
Zentmyer et al.

(10) Patent No.: US 6,237,307 B1
(45) Date of Patent: May 29, 2001

(54) APPARATUS AND METHOD FOR MANUALLY APPLYING STRETCH FILM TO PALLETIZED PRODUCTS

(75) Inventors: Hugh J. Zentmyer, Green Oaks; Gale W. Huson, Glenview, both of IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/432,284

(22) Filed: Nov. 2, 1999

(51) Int. Cl.[7] ..... B65B 13/04; B65B 53/00

(52) U.S. Cl. ..... 53/399; 53/390; 53/441; 53/556; 53/588

(58) Field of Search ..... 53/556, 441, 399, 53/588, 592, 390, 587

(56) References Cited

U.S. PATENT DOCUMENTS

| | | | | |
|---|---|---|---|---|
| D. 272,540 | * | 2/1984 | Goldstein | 53/587 |
| 4,369,614 | * | 1/1983 | Tetzner | 53/588 |
| 4,938,008 | | 7/1990 | Salzsauler . | |
| 5,296,079 | * | 3/1994 | Romo | 53/588 |
| 5,398,884 | | 3/1995 | Stanford . | |
| 5,423,163 | * | 6/1995 | Wendt | 53/556 |
| 5,458,841 | | 10/1995 | Shirrell . | |
| 5,561,971 | * | 10/1996 | Sampson | 53/588 |
| 5,673,542 | * | 10/1997 | Vartanian et al. | 53/588 |
| 5,779,179 | | 7/1998 | Zentmyer et al. . | |

OTHER PUBLICATIONS

Low Profile Stretchwrap Machine, Manual Spiral Wrapper, Operators Manual, Model G–200 Gerrard & Company, Apr. 1998.

* cited by examiner

*Primary Examiner*—Stephen F. Gerrity
(74) *Attorney, Agent, or Firm*—Schwartz & Weinrieb

(57) ABSTRACT

An apparatus and method for manually applying stretch film to palletized loads or products comprises a vertically upstanding mast member, a horizontally extending static boom member connected to the mast member, a horizontally extending orbiting boom member rotatably connected to the static boom member, and a vertically extending downright member connected to the orbiting boom member. A carriage assembly carrying a roll of stretch film is movably mounted upon the downright member in a counterbalanced manner, and an operator handle is fixed upon the carriage assembly so as to enable an operator to manually push the carriage assembly, the downright member, and the orbiting boom member in a circular locus around a wrapping station at which a palletized load or product is disposed for wrapping. The mounting of the carriage assembly upon the downright member in the counterbalanced mode enables the operator to perform the manual wrapping of the palletized load or product without having to support the weight of the film roll and its core. In addition, the handle has an elongated vertical extent so as to enable the operator to wrap lowermost portions of the palletized load or product without having to bend or stoop.

22 Claims, 4 Drawing Sheets

10
12
14
16
18
20
22
24
26
28
30
32
34
36
38
40
42
46
66
82
88
89
90
94

APPARATUS AND METHOD FOR MANUALLY APPLYING STRETCH FILM TO PALLETIZED PRODUCTS

FIELD OF THE INVENTION

The present invention relates generally to an apparatus and method for applying stretch film to palletized loads or products, and more particularly to a new and improved apparatus and method for manually applying stretch film to palletized loads or products.

BACKGROUND OF THE INVENTION

It is a known fact that approximately fifty percent (50%) of all stretch film that is manufactured is applied to, for example, palletized loads or products by manual means. It is also known that when applying such stretch film to, for example, palletized loads or products, the manner in which such stretch film is manually applied to such loads or products usually comprises either one of two methods. In accordance with a first one of such manual methods, as illustrated, for example, within U.S. Pat. No. 5,398,884 which issued to Stanford on Mar. 21, 1995, the operator respectively inserts four fingers of each hand into each one of two oppositely disposed recessed portions defined within the film core end caps so as to effectively hold or grasp the film roll, and while placing his thumbs upon outside surface portions of the film roll, so as to effectively cause a predetermined amount of back tension to be applied to the film whereby the film is effectively stretched as the film is being unrolled or dispensed from the film roll, the operator walks around the palletized load or product. In accordance with a second one of such manual methods of applying a stretch film to such palletized loads or products, as illustrated, for example, within U.S. Pat. No. 5,458,841 which issued to Shirrell on Oct. 17, 1995, and in lieu of directly holding or grasping the film roll, the operator holds or grasps a film roll dispensing or holding device which has a built-in tensioning mechanism.

In accordance with either one of the aforenoted modes, methods, or manners in which stretch film is applied manually to the palletized products or loads, several operational disadvantages or drawbacks common to both methods or modes are apparent. Firstly, for example, the film roll or the film roll and film roll dispensing or holding device must be supported by the operator personnel, yet the film roll and film roll dispensing or holding device are quite heavy and cumbersome. In addition, in order to fully wrap a palletized load, the operator must bend down while holding the film roll or film roll and film roll dispensing or holding device in order to wrap the film around the lower extremity portions of the palletized loads or products. Such requirements upon the operator personnel cause acute discomfort, fatigue, and stress-related injuries. In addition, the operators experience fatigue and discomfort even when the operators are wrapping upper regions of the palletized loads or products due to the need for supporting the entire weight of the film roll or film roll and film roll dispensing or holding device.

A need therefore exists in the art for an apparatus, and a method of operating the same, for overcoming the various operational disadvantages or drawbacks characteristic of the known PRIOR ART systems as briefly discussed hereinbefore and as disclosed within the aforenoted patents.

OBJECTS OF THE INVENTION

Accordingly, it is an object of the present invention to provide a new and improved apparatus, and a method of operating the same, for applying stretch film to palletized loads or products.

Another object of the present invention is to provide a new and improved apparatus, and a method of operating the same, for applying stretch film to palletized loads or products wherein the various operational drawbacks and disadvantages characteristic of PRIOR ART apparatus, systems, or methods of operating the same, are overcome.

An additional object of the present invention is to provide a new and improved apparatus, and a method of operating the same, for applying stretch film to palletized loads or products wherein the stretch film can be applied to or wrapped around the palletized loads or products by means of operator personnel who can simply walk around the pallet upon which the loads or products are disposed and simultaneously push or guide the roll of stretch film around the palletized loads or products whereby the palletized loads or products are accordingly wrapped with such stretch film.

A further object of the present invention is to provide a new and improved apparatus, and a method of operating the same, for applying stretch film to palletized loads or products wherein the stretch film can be applied to or wrapped around the entire vertical extent of the palletized loads or products by means of operator personnel who need not support the weight of the film roll or the film roll and the film roll dispensing mechanism, and in addition need not bend down in order to wrap or apply the stretch film upon or to the lower extremity portions of the palletized loads or products.

SUMMARY OF THE INVENTION

The foregoing and other objectives are achieved in accordance with the teachings and principles of the present invention through the provision of a new and improved apparatus, and a method of operating the same, which comprises a vertically extending mast and a horizontally extending static boom having one end thereof affixed to the upper end of the vertically extending mast. The vertically extending mast may be affixed to vertically extending column or wall, or may have a weighted based affixed to the lower end of the vertically extending mast so as to render the entire apparatus or system portable. An orbiting boom has a first end thereof pivotally mounted upon the second free end of the horizontally extending static boom, and a vertically extending downright member is fixedly mounted upon a second free end of the orbiting boom. The lower end of the downright is provided with a spring-biased wheel assembly for supporting the downright and orbiting boom structure upon a manufacturing facility floor at which a wrapping station is defined for supporting palletized loads or products to be wrapped in stretch film. A vertically reciprocable carriage is mounted upon the downright, and a roll of stretch film is mounted upon one side of the carriage while an ergonomic handle is mounted upon an opposite side of the carriage so as to positionally manipulate the carriage upwardly and downwardly along the downright as well as to effectively orbitally move film roll around the palletized load or product disposed at the wrapping station and to be wrapped.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figures 1, 2A, 2B:
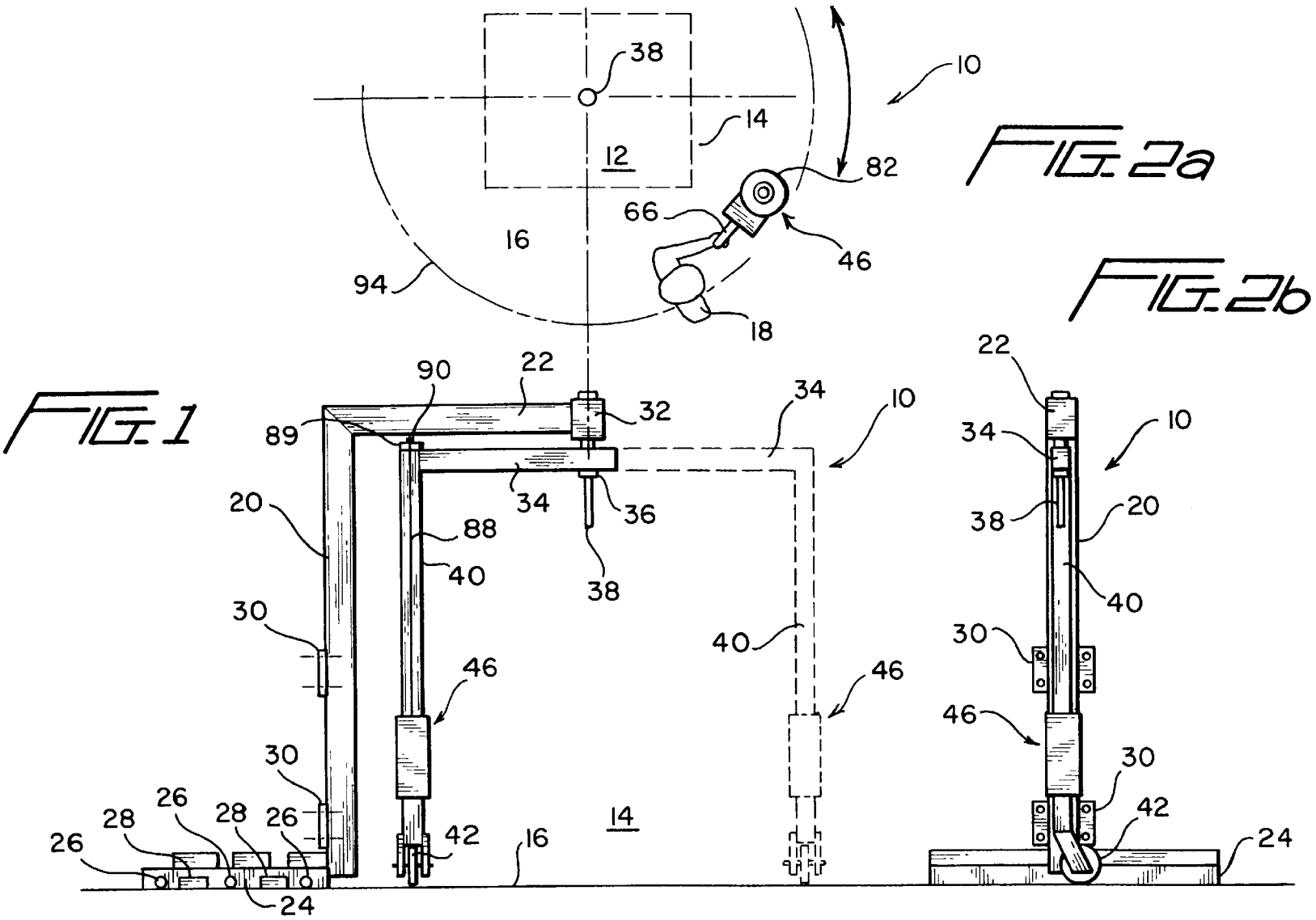
FIG. 1 is a front elevational view of a new and improved apparatus or system as constructed in accordance with the principles and teachings of the present invention for manually applying stretch film to palletized loads or products.
FIG. 2*a* is a top, partial schematic plan view of the new and improved apparatus or system as shown in FIG. 1 showing how operator personnel would guide the movement of the film roll, as mounted upon the film roll carriage, during a wrapping operation performed with respect to a palletized load or product disposed at the facility wrapping station.
FIG. 2*b* is a side elevational view of the new and improved apparatus or system constructed in accordance with the principles and teachings of the present invention and as shown in FIG. 1.

Referring now to the drawings, and more particularly to FIGS. 1,2*a* and 2*b* thereof, the new and improved apparatus or system constructed in accordance with the principles and teachings of the present invention, for manually applying stretch film to palletized loads or products, is disclosed and is generally designated by the reference character 10. As may best be appreciated from FIG. 2*a*, a palletized load or product 12, shown in phantom lines, is adapted to be placed, positioned, or disposed at a wrapping station 14 which is defined upon a floor region 16 of a stretch film wrapping facility, and a stretch film is adapted to be manually wrapped around the palletized load or product 12 by means of an operator 18 utilizing the new and improved stretch film wrapping apparatus or system 10 constructed in accordance with the principles and teachings of the present invention.

More particularly, as best appreciated from FIGS. 1 and 2*b*, the new and improved stretch film wrapping apparatus or system 10 constructed in accordance with the principles and teachings of the present invention is seen to comprise a vertically extending mast member 20 and a horizontally extending static boom member 22 which has a first end portion thereof fixedly mounted upon or integrally fixed to the upper end portion of the vertically extending mast member 20. The lower end portion of the vertically extending mast member 20 is, in accordance with a first embodiment or variation of the present invention apparatus or system, fixedly attached to a weighted base member 24 which is adapted to be disposed upon the floor region 16 of the facility such that the entire apparatus or system 10 is effectively freestanding. In addition, the apparatus or system 10 is also thus rendered portable.

In order to facilitate the portability of the apparatus or system 10, the base member 24 may be provided with spaced arrays of internal wheel members 26 which are adapted to engage and roll upon the facility floor 16 whereby the apparatus or system 10 may be moved over the floor surface 16, or alternatively, the base member 24 may be provided with a pair of spaced slots 28 for accommodating the tines of fork-lift apparatus whereby the apparatus or system 10 can be transported between wrapping station locations by means of suitable fork-lift apparatus. Still further, and in accordance with a second embodiment or variation of the present invention apparatus or system, the vertically extending mast member 20 may be provided with a plurality of vertically spaced mounting plates or brackets 30 by means of which the vertically extending mast member 20 may be fixedly secured to an upstanding column, not shown, or to a vertical wall member, also not shown, of the manufacturing facility.

A second end portion of the static boom member 22, which is disposed opposite the first end portion thereof which is fixedly or integrally attached to the upper end portion of the vertically extending mast member 20, is provided with a bearing system 32 by means of which a first end portion of an orbiting boom member 34 is pivotally or rotationally attached to the static boom member 22 through means of an axle member 36 which is rotatably disposed within the bearing system 32 of the static boom member 22. A dependent coil spring member 38 is fixedly mounted upon the axle member 36 so as to rotate with the axle member 36 and the orbiting boom member 34 with respect to the fixed or static boom member 22.

As may be appreciated, the dependent spring member 38 is located above the palletized load or product 12 and is in effect disposed coaxially with respect to the wrapping station 14, as illustrated in FIG. 2*a*, so as to serve as a visual aid for assisting operator personnel 18 in connection with the proper disposition, centering, or alignment of a palletized load or product 12 with respect to the center of the wrapping station 14 whereby the palletized load or product 12 can be properly wrapped with the stretch film as will be more fully appreciated hereinafter. It is further noted that the visual alignment aid 38 is in the form of a flexible and resilient coil spring, somewhat similar to a coil spring conventionally utilized in connection with the support, balance, and movement of garage doors. In this manner, should a palletized load or product 12, for example, collide with the spring member 38 during movement and positioning of the palletized load or product 12 in connection with the insertion or removal of the palletized load 12 into and out from the wrapping station 14, the coil spring member 38 will simply deflect and inherently return to its normal vertically axial orientation with respect to the wrapping station 14. Alternatively, if the visual aid member 38 comprised, for example, a rigid bar member, such collision with the visual aid member 38 by means of, for example, a palletized load or product 12 would damage either the visual aid member 38 and/or the palletized load or product 12 necessitating replacement of the visual aid member 38 and some form of compensation to be made with respect to the palletized load or product 12.

Figure 4:
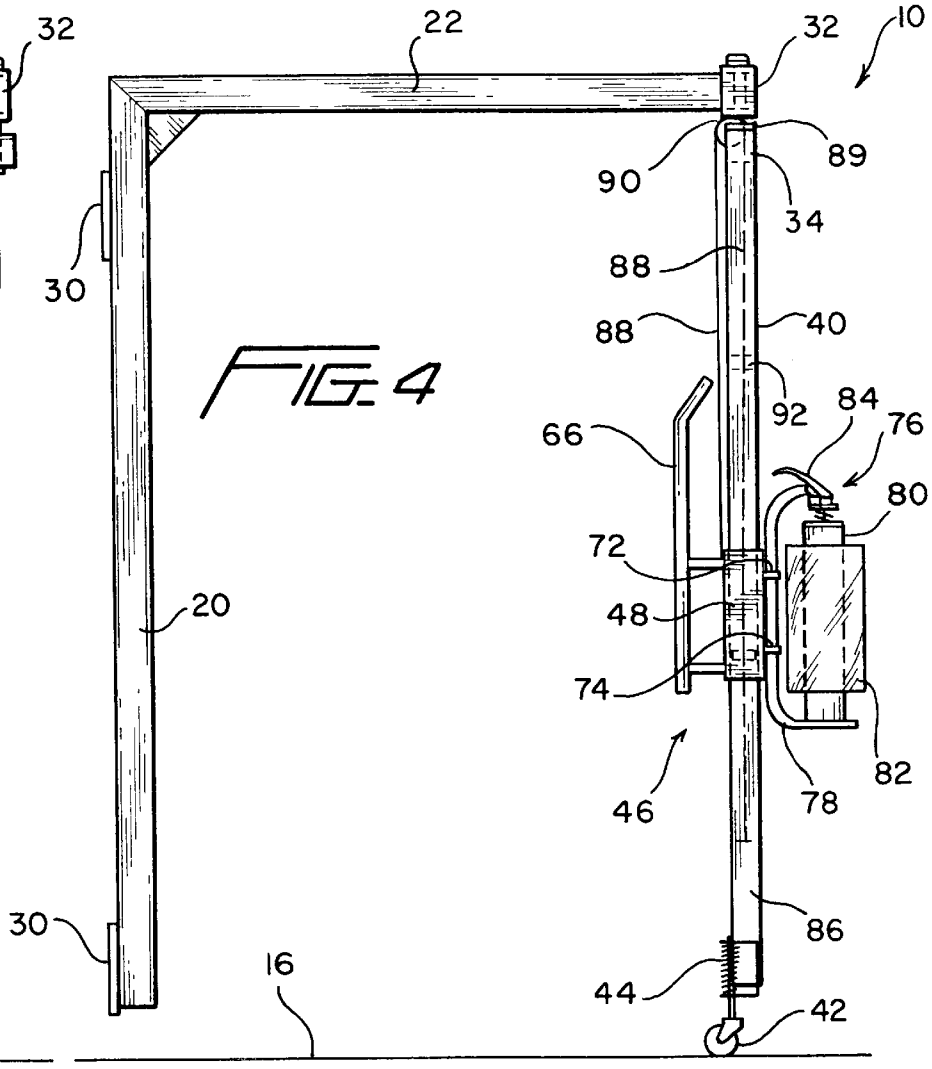
FIG. 4 is a partial, front elevational view of the new and improved apparatus or system constructed in accordance with the principles and teachings of the present invention and as shown in FIGS. 1 and 3, and showing the relative disposition of the orbiting boom and the downright member, upon which the operator's handle, the film roll carriage, and the film roll dispensing mechanism are mounted, with respect to the mast and static boom when the orbiting boom and downright member are disposed at an angular position of 90° with respect to the mast and static boom.
Figure 3:
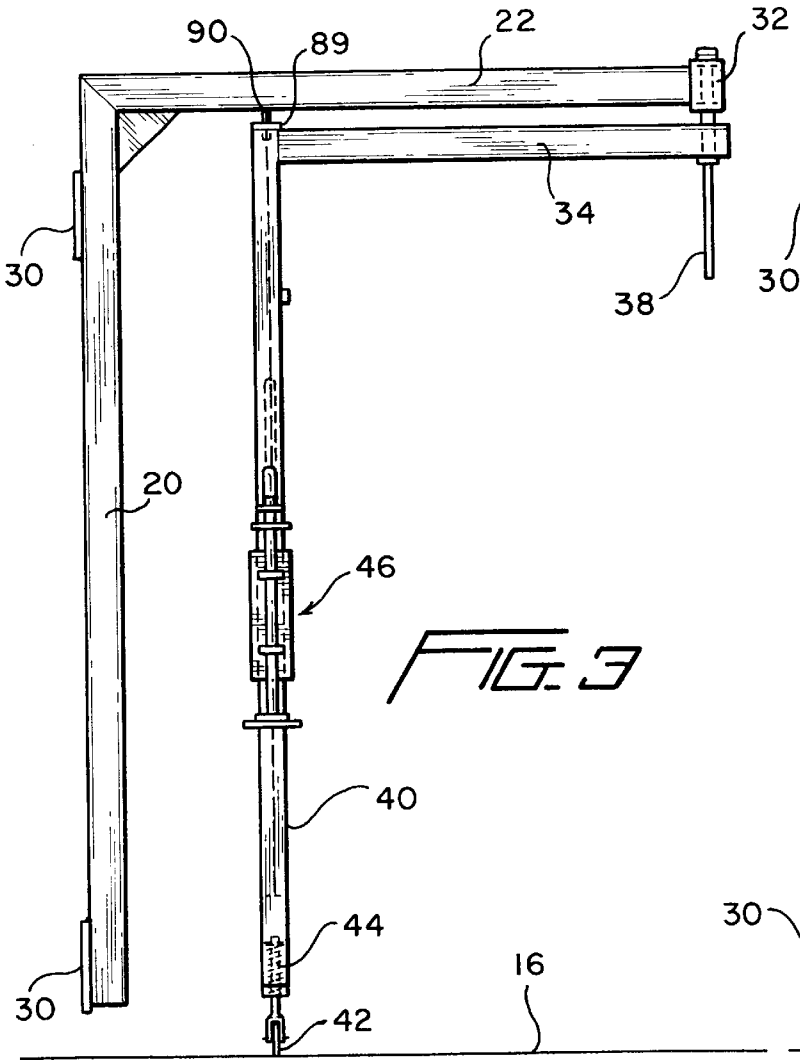
FIG. 3 is a partial, front elevational view of the new and improved apparatus or system constructed in accordance with the principles and teachings of the present invention and as shown in FIG. 1, and showing the relative disposition of the orbiting boom and the downright member, upon which the operator's handle, the film roll carriage, and the film roll dispensing mechanism are mounted, with respect to the mast and static boom when the orbiting boom and downright member are disposed at an angular position of 0° with respect to the mast and static boom.
Figure 5:
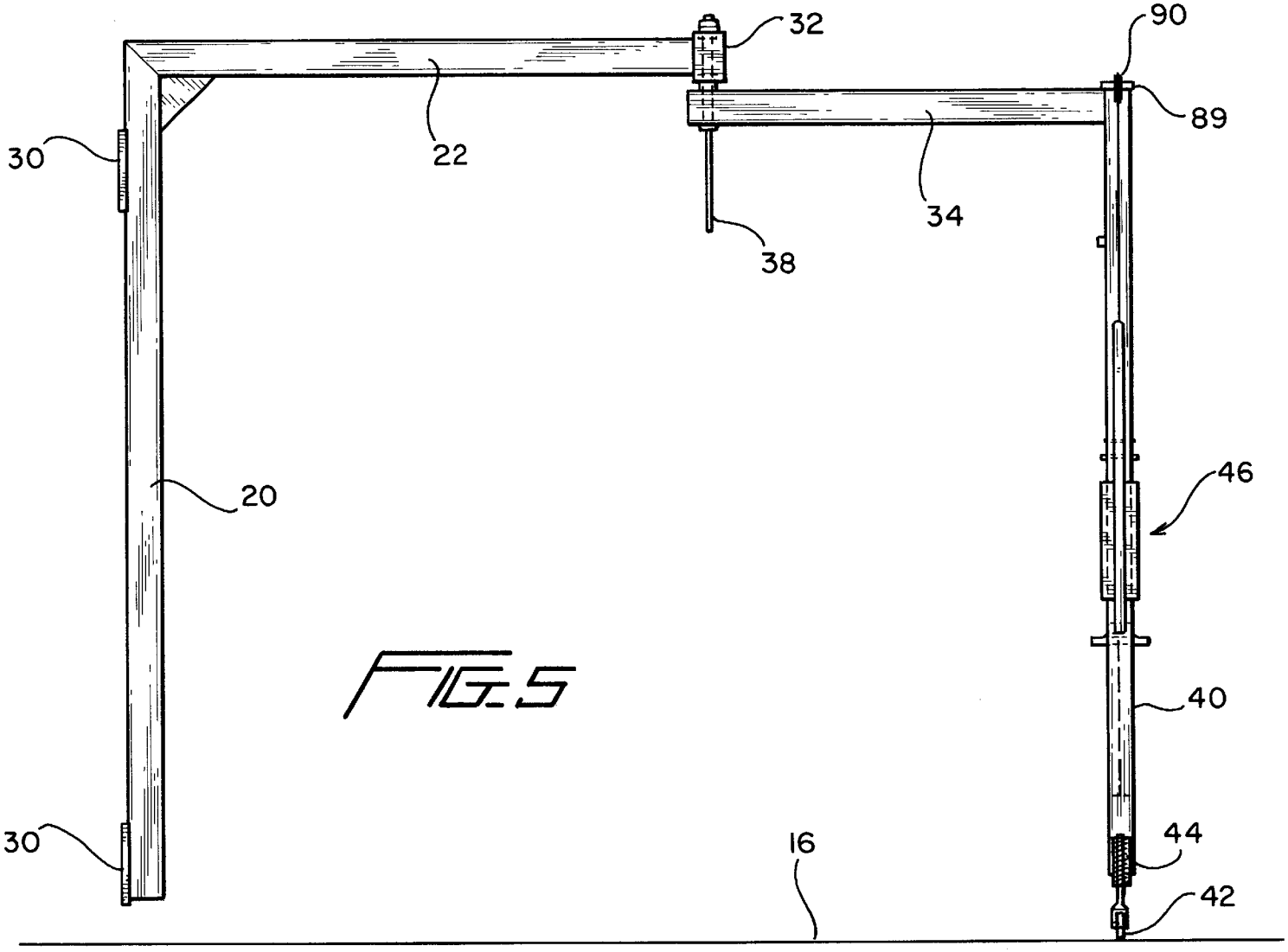
FIG. 5 is a partial, front elevational view of the new and improved apparatus or system constructed in accordance with the principles and teachings of the present invention and as shown in FIGS. 1,3, and 4, and showing the relative disposition of the orbiting boom and downright member, upon which the operator's handle, the film roll carriage, and the film roll dispensing mechanism are mounted, with respect to the mast and static boom when the orbiting boom and downright member are disposed at an angular position of 180° with respect to the mast and static boom.
Figure 7:
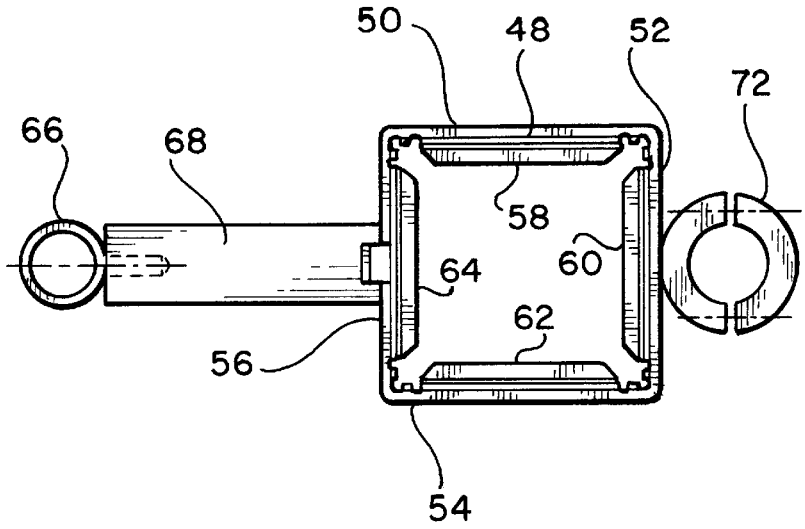
FIG. 7 is a top plan view of the film roll carriage, the operator handle, and the film roll mounting bracket assembly as shown in FIG. 6.
Figure 6:
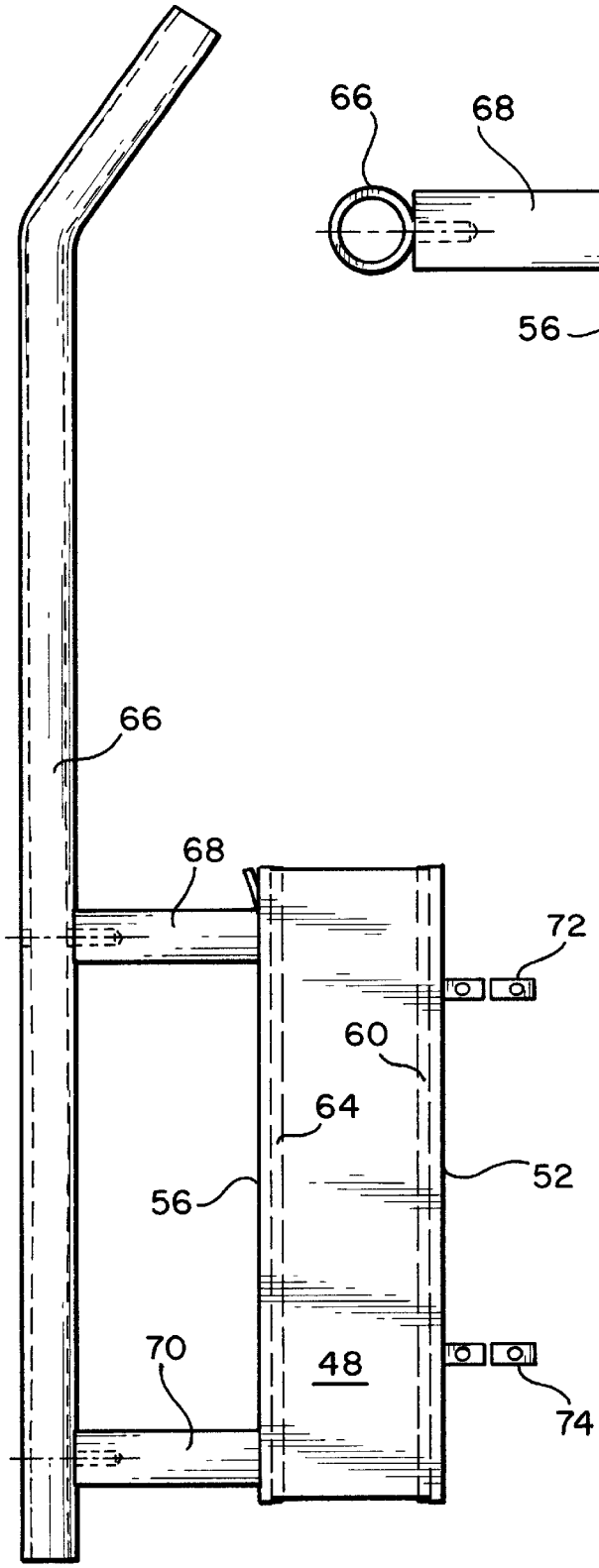
FIG. 6 is a side elevational view of the film roll carriage, the operator handle, and the film roll mounting bracket assembly as mounted upon the downright member as shown in FIG. 4.

With continued reference being made to FIGS. 1 and 2*b*, a first upper end portion of a vertically disposed downright member 40 is fixedly secured or attached to a second distal end portion of the orbiting boom member 34, and the second lower end portion of the downright member 40 is provided with a support wheel mechanism or assembly 42 which is adapted to engage the floor 16 of the manufacturing facility so as to support the downright member 40 and the orbiting boom member 34 during rotational movements of the orbiting boom member 34 and the downright member 40 around the wrapping station 14 in connection with the performance of wrapping operations being conducted upon the palletized load or product 12. As best seen from FIGS. 3–5, the support wheel mechanism or assembly 42 is supported or mounted upon the lower end portion of the downright member 40 by means of a suitably adjustable spring-biased mounting system 44. In this manner, the spring constant characteristics of the system 44 can be adjusted so as to properly support the weight of the downright member 40, the orbiting boom member 34, and a stretch film carriage assembly 46 mounted upon the downright member 40 as will be discussed shortly hereinafter, as well as to provide for the proper resiliency and shock absorption properties or characteristics within the system 44 as may be required during rotational movement of the support wheel assembly or mechanism 42 upon the floor 16 of the manufacturing facility.

With reference now being made to FIGS. 3–7, it is to be appreciated that the downright member 40 comprises a hollow tubular member having a substantially square cross-sectional configuration, and the aforenoted carriage assembly, generally indicated by the reference character 46, is adapted to be mounted upon the exterior of the downright member 40 so as to be movable upwardly and downwardly along the exterior surface portions of the downright member 40 in a reciprocating manner in accordance with known stretch film wrapping techniques in connection with the stretch film wrapping of a palletized load or product 12 disposed at the wrapping station 14 of the manufacturing facility. As may best be appreciated from FIGS. 4,6, and 7, the carriage assembly 46 is seen to comprise a carriage 48 which, similar to the structure of the downright member 40, also comprises a hollow tubular structure having a substantially square cross-sectional configuration as defined by four sides 50, 52,54,56. Upon the interior surface of each one of the sides 50–56 defining the carriage 48, a glide member 58,60,62,64 is provided for engaging and riding upon a corresponding external surface portion of the downright member 40. The glide members 58–64 may be suitably fabricated, for example, from ultra-high molecular weight polyethylene (UHMWPE) such that the carriage 48, and therefore the entire carriage assembly 46, is readily and relatively easily movable along the downright member 40, and yet, nevertheless, as will be more fully discussed hereinafter, a sufficient amount of friction is developed between each one of the glide members 58–64 and its corresponding exterior surface of the downright member 40. In this manner, when the carriage assembly 46 is moved along the downright member 40 to a particularly desired elevational position or level at which stretch film is to be dispensed in connection with a film wrapping operation being performed upon a palletized load or product 12, the carriage assembly 46 will be automatically or inherently maintained at such elevational position or level such that the operator 18 need not exert any upward or downward force upon the carriage assembly 46 so as to hold or maintain the carriage assembly 46 at such elevational position or level. As will become apparent, the operator 18 need only exert in effect a substantially horizontally directed force which pushes the carriage assembly 46, and, in effect, the downright member 40 and the orbiting boom member 34, around the palletized load or product 12 disposed at the wrapping station 14 such that stretch film, from the carriage assembly 46, can be wrapped around the palletized load or product 12.

In order to facilitate such aforenoted upward or downward positional movement of the carriage assembly 46 along the downright member by the operator 18, as well as the aforenoted horizontally directed force impressed upon the carriage assembly 46, and the downright and orbiting boom members 40,34, in a comfortable manner by means of the operator 18, an operator handle 66 is fixedly attached to side 56 of the carriage 48 by means of a pair of vertically spaced mounting brackets 68,70. The handle 66 has a substantially large vertical extent, and it is to be particularly appreciated that at least one half of the vertical extent of the handle 66, that is, the upper half of the handle 66, is disposed above the carriage 48 such that when the operator 18 grasps the handle 66, the operator 18 can effect any one of the aforenoted required positional adjustments of the carriage assembly 46 along the downright member 40, as well as the rotational movement of the carriage assembly 46, the downright member 40, and the orbiting boom member 34, around the palletized load or product 12 without the need for bending or stooping downwardly toward the facility floor 16 which is operationally fatiguing. In addition, it is further noted that the uppermost end portion of the handle 66 is bent at angle of approximately 30° with respect to the vertical axis of the handle 66 such that the uppermost hand grasp portion of the handle 66 is ergonomically comfortable.

The opposite side 52 of the carriage 48 is also provided with a pair of vertically spaced mounting brackets 72,74 by means of which a stretch film applicator or dispenser, generally indicated by the reference character 76, may be mounted upon the carriage 48. The stretch film applicator or dispenser 76 may be of the type disclosed within U.S. Pat. No. 5,779,179 which issued to Zentmyer et al. on Jul. 14, 1998, and is seen to basically comprise a substantially C-shaped holder 78 for mounting a stretch film roll core 80 upon which a roll of stretch film 82 is disposed. The applicator or dispenser 76 is further provided with a spring-biased release mechanism 84, which is more particularly disclosed within the aforenoted U.S. Pat. No. 5,779,179, for facilitating replacement of a depleted roll of stretch film 82 with a new roll of stretch film 82 without the need, for example, for removing the applicator dispenser 76 from the carriage assembly 46.

As was noted hereinbefore, the downright member 40 comprises a hollow tubular member, and in order to facilitate the vertical movement or positional adjustment of the carriage assembly 46 along the downright member 40 in a weight-balanced mode whereby the operator 18 is effectively relieved of the weight of the entire carriage assembly 46, the carriage 48 is operatively connected to a counterweight component 86 which is housed or disposed internally within the downright member 40. A cable 88 is attached at a first end portion thereof to the counterweight 86, and extends upwardly internally within the hollow interior of the downright member 40. The upper end of the downright member 40 is provided with a suitable pulley mounting bracket 89, and accordingly, the cable 88 extends upwardly and is conducted over a pulley member 90 which is mounted within the pulley mounting bracket 89 whereupon the cable 88 then extends downwardly and externally of the downright member 40 such that a second end portion of the cable 88 is able to be attached to the carriage 48. The counterweight is specifically weighted or fabricated so as to exhibit a weight mass which is substantially equal to the weight of the carriage 48, the film core 80, and one-half of the weight of a full roll of stretch film 82. In this manner, as the operator 18 moves the carriage assembly 46 upwardly or downwardly so as to operatively position the same upon the downright member 40 and relative to a particular palletized load or product 12 so as to optimally provide or facilitate dispensing of the stretch film from the roll of stretch film 82 and onto the palletized load or product 12 being wrapped, the counterweight 86 accordingly or correspondingly moves downwardly or upwardly so as to achieve the movement of the carriage assembly 46 in the aforenoted balanced mode whereby the operator 18 need not, in particular, support the weight of the carriage assembly 46, particularly during the operative stretch film wrapping of the palletized load or product 12 as was characteristic of the PRIOR ART modes of operation as discussed hereinbefore.

It is also to be noted that in order to eliminate the generation of any noise or chatter between the counterweight 86 and the interior of the downright member 40 when the counterweight 86 is moved upwardly and downwardly relative to the downright member 40, the external surfaces of the counterweight 86 may be coated with a suitable sound-deadening or sound-absorbing material which may therefore prevent the generation of such noise while not inhibiting the movement of the counterweight member 86 within the downright member 40. Still further, in order to limit the upper extent to which the carriage assembly 46 is able to be moved relative to a palletized load or product 12 to be wrapped at the wrapping station 14, a stop bar 92 fixedly mounted upon an external surface portion of the downright member 40 at a predetermined elevational level which corresponds to the maximum height the carriage assembly 46 would need to be moved in order to achieve the stretch film wrapping of all regions of the palletized load or product 12. Alternatively, in order to accommodate different palletized loads or products 12 having different height dimensions, the downright member 40 may be provided with a plurality of sets of, for example, vertically spaced apertures, not shown, within which suitable fasteners may be disposed so as to fasten the stop bar 92 at different elevational positions upon the downright member 40 which correspond to the maximum height level to which the carriage assembly 46 is to be moved with respect to a particular palletized load or product 12 to be wrapped.

Thus, it may be seen that in accordance with the teachings and principles of the present invention, there has been provided a new and improved apparatus for manually applying stretch film to palletized loads or products. As can be appreciated from FIG. 2*a*, and in accordance with the method of the present invention, after the operator 18 has adjusted the carriage assembly 46 to a particular elevational position at which, for example, the wrapping operation is to commence, the operator 18 simply uses the carriage assembly handle 66 to exert a pushing force upon carriage assembly 46 which in turn causes the downright member 40 and the orbiting boom member 34 to rotate or revolve around the wrapping station 14 at which a palletized load or product 12 is located so as to cause wrapping of the palletized load or product 12 by means of the stretch film being dispensed from the roll of stretch film 82. The downright member 40 defines, in effect, a circular path or locus 94, and during such movement of the carriage assembly 46 and the roll of stretch film 82 along such circular path or locus 94, the operator 18 can also easily move the carriage assembly upwardly or downwardly so as to achieve complete wrapping of the palletized load or product 12 disposed at the wrapping station 14. Such upward or downward movement of the carriage assembly 46, simultaneous with the rotational or revolutionary movement of the carriage assembly 46 along the circular path or locus 94, is of course readily achieved due to the weight-balanced mode established in connection with the carriage assembly 46 by means of the counterweight 86 and its attachment to the carriage assembly 46. It is lastly noted that while the operator 18 has been depicted as walking in a counterclockwise direction as illustrated in FIG. 2*a*, it is to be appreciated that the operator 18 can likewise walk and therefore achieve wrapping of the palletized load or product 12 in a clockwise manner.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. Apparatus for manually wrapping film around an article, comprising:

a wrapping station at which an article to be wrapped in film can be disposed;

a roll of film from which film can be dispensed so as to wrap an article disposed at said wrapping station within said dispensed film;

support means, having said roll of film mounted upon said support means, rotatable about a vertical axis defined at said wrapping station for permitting film from said roll of film to be wrapped around an article disposed at said wrapping station as said film is dispensed from said roll of film;

manual means operatively connected to said support means for enabling an operator to move said support means, and said roll of film mounted thereon, in a substantially circular locus around said vertical axis of said wrapping station, as well as in a predetermined vertical direction substantially parallel to said vertical axis of said wrapping station, so as to achieve wrapping of an article disposed at said wrapping station within film dispensed from said roll of film; and counterbalancing means operatively connected to said support means and movable in a vertical direction which is substantially opposite to said predetermined vertical direction of movement of said support means, and said roll of film disposed thereon, for counterbalancing the weight of said support means and said roll of film such that an operator does not have to support said support means and said roll of film while the operator is moving said support means, and said roll of film mounted thereon, along said substantially circular locus so as to wrap an article disposed at said wrapping station within film dispensed from said roll of film.

2. The apparatus as set forth in claim 1, wherein said support means comprises:

a vertically extending mast member;

a vertically extending downright member rotationally connected to said vertically extending mast member; and a carriage, having said roll of film mounted thereon, movably adjustably mounted upon said downright member.

3. The apparatus as set forth in claim 2, wherein:

said downright member comprises a hollow tubular member; and said counterbalancing means comprises a counterweight disposed within said hollow tubular downright member and operatively connected to said carriage.

4. The apparatus as set forth in claim 3, wherein:

the weight of said counterweight is substantially equal to the sum of the weight of said carriage, the weight of a core member of said roll of film, and one-half of the weight of a complete roll of film.

5. The apparatus as set forth in claim 3, further comprising:

a cable operatively connected at a first end thereof to said carriage, and operatively connected at a second end thereof to said counterweight.

6. The apparatus as set forth in claim 2, wherein:

said manual means comprises handle means mounted upon said carriage for enabling an operator to move said downright member, said carriage mounted upon said downright member, and said roll of film mounted on said carriage along said substantially circular locus around said wrapping station.

7. The apparatus as set forth in claim 6, wherein:

said handle means has a predetermined vertical extent, defined by a vertical axis, disposed vertically above said carriage so as to enable an operator to elevationally lower said carriage to an elevational level at which film from said roll of film can be dispensed around lowermost portions of an article to be wrapped without requiring the operator to bend downwardly.

8. The apparatus as set forth in claim 6, wherein:

said handle means has an upper end portion which is bent at a predetermined angle with respect to said vertical axis of said handle means so as to facilitate ergonomic grasping of said handle means by an operator.

9. The apparatus as set forth in claim 2, further comprising:

a horizontally extending static boom member having a first end portion thereof fixedly connected to said vertically extending mast member; and a horizontally extending orbiting boom member having a first end portion thereof rotationally connected to a second end portion of said horizontally extending static boom member, and having a second end portion thereof fixedly connected to an upper end portion of said downright member.

10. The apparatus as set forth in claim 9, further comprising:

wheel means mounted upon a lower end portion of said downright member for engaging a floor region surrounding said wrapping station so as to support said downright member, said orbiting boom member, and said carriage during rotational movement of said orbiting boom member, said downright member, and said carriage along said substantially circular locus during a film wrapping operation.

11. The apparatus as set forth in claim 9, further comprising:

visual aid means fixedly mounted upon and depending downwardly from said said first end portion of said orbiting boom member for facilitating placement of an article to be wrapped at the center of said wrapping station.

12. The apparatus as set forth in claim 2, further comprising:

a portable base member to which said vertically extending mast member is fixedly attached, whereby said apparatus is rendered portably movable with respect to said wrapping station.

13. The apparatus as set forth in claim 12, further comprising:

wheel means provided upon said portable base member so as to facilitate portable rolling movement of said apparatus.

14. The apparatus as set forth in claim 12, further comprising:

slot means defined within said portable base member for accommodating fork-lift apparatus for transporting said apparatus to and from said wrapping station.

15. The apparatus as set forth in claim 2, further comprising:

bracket means for fixedly attaching said vertically extending mast member to a vertical support.

16. The apparatus as set forth in claim 2, wherein:

said downright member has a substantially square-shaped cross-sectional configuration; and said carriage comprises a hollow tubular structure having a substantially square-shaped cross-sectional configuration and disposed around external surface portions of said downright member.

17. The apparatus as set forth in claim 16, further comprising:

glide members fixedly mounted upon internal surface portions of said carriage for engaging said external surface portions of said downright member, whereby said glide members permit said carriage to be elevationally adjusted along said downright member to a predetermined elevational position yet generate sufficient friction with respect to said external surface portions of said downright member such that said carriage is retained at said predetermined elevational position.

18. The apparatus as set forth in claim 17, wherein:

each one of said glide members is fabricated from ultra-high molecular weight polyethylene (UHMWPE).

19. Apparatus for manually wrapping stretch film around a palletized load, comprising:

a wrapping station at which a palletized load to be wrapped in stretch film can be disposed;

a roll of stretch film from which stretch film can be dispensed so as to wrap a palletized load disposed at said wrapping station within said dispensed stretch film;

support means, having said roll of stretch film mounted upon said support means in an elevationally adjustable manner, rotatable about a vertical axis defined at said wrapping station for permitting stretch film from said roll of stretch film to be wrapped around a palletized load disposed at said wrapping station as said stretch film is dispensed from said roll of stretch film;

manual means operatively connected to said support means for enabling an operator to move said support means, and said roll of stretch film mounted thereon, in a substantially circular locus around said vertical axis of said wrapping station, as well as in a predetermined vertical direction substantially parallel to said vertical axis of said wrapping station, so as to achieve wrapping of a palletized load disposed at said wrapping station within stretch film dispensed from said roll of stretch film; and counterbalancing means operatively connected to said support means and movable in a vertical direction which is substantially opposite to said predetermined vertical direction of movement of said support means, and said roll of film disposed thereon, for counterbalancing the weight of said support means and said roll of stretch film such that an operator does not have to support said support means and said roll of stretch film while the operator is moving said support means, and said roll of stretch film mount thereon, along said substantially circular locus so as to wrap a palletized disposed at said wrapping station within stretch film dispensed from said roll of stretch film.

20. A method of wrapping an article in film, comprising the steps of:

placing an article at a wrapping station defining a vertical axis;

mounting a roll of film, from which wrapping film can be dispensed so as to wrap said article disposed at said wrapping station, upon a carriage;

mounting said carriage, having said roll of film mounted thereon, in a vertically movable manner upon a support member which is rotatable about said vertical axis defined at said wrapping station such that as said support member is rotated about said vertical axis defined at said wrapping station, said wrapping film is dispensed from said roll of film and wrapped around said article disposed at said wrapping station;

operatively connecting said carriage to a vertically movable counterweight such that as said carriage, having said roll of film mounted thereon, is moved in a first predetermined vertical direction, said counterweight is moved in a second vertical direction which is substantially opposite to said first predetermined vertical direction; and manually pushing said support member, said carriage, and said roll of film mounted upon said carriage, by an operator in a substantially circular locus around said vertical axis defined at said wrapping station so as to achieve wrapping said article disposed at said wrapping station within said film dispensed from said roll of film without requiring said operator to support the weight of said carriage and said roll of film while said operator is moving said support means, said carriage, and said roll of film mounted thereon, along said substantially circular locus around said vertical axis defined at said wrapping station so as to wrap said article disposed at said wrapping station within said film dispensed from said roll of film.

21. The method as set forth in claim 20, wherein:

said operator manually pushes said support member, said carriage, and said roll of film mounted upon said carriage, in a counterclockwise direction around said wrapping station.

22. The method as set forth in claim 20, wherein:

said operator manually pushes said support member, said carriage, and said roll of film mounted upon said carriage, in a clockwise direction around said wrapping station.

* * * * *